United States Patent [19]

Morozumi

[11] 4,124,975

[45] Nov. 14, 1978

[54] CALENDAR WATCH

[75] Inventor: Shinji Morozumi, Hachioji, Japan

[73] Assignee: Orient Watch Co., Ltd., Tokyo, Japan

[21] Appl. No.: 736,219

[22] Filed: Oct. 27, 1976

[30] Foreign Application Priority Data

Mar. 4, 1976 [JP] Japan ..... 51-25775[U]

[51] Int. Cl.[2] ..... G04B 19/24

[52] U.S. Cl. ..... 58/58; 58/4 R; 58/125 B; 58/126 B; 58/127 R

[58] Field of Search ..... 58/4 R, 5, 58, 125 B, 58/126 A, 126 B, 127 R, 128, 85.5; 40/107, 113, 115

[56] References Cited

U.S. PATENT DOCUMENTS

| | | | |
|---|---|---|---|
| 1,692,758 | 11/1928 | Nogrady | 40/115 |
| 1,968,444 | 7/1934 | Farber | 58/58 X |
| 2,507,697 | 5/1950 | Donow | 40/115 |
| 3,470,687 | 10/1969 | Ono et al. | 58/85.5 |
| 3,712,043 | 1/1973 | Egger et al. | 58/58 X |
| 3,760,585 | 9/1973 | Wein | 58/58 |
| 3,811,266 | 5/1974 | Samura | 58/58 |
| 3,842,590 | 10/1974 | Kato | 58/58 |

*Primary Examiner*—Ulysses Weldon
*Attorney, Agent, or Firm*—Fleit & Jacobson

[57] ABSTRACT

A calendar watch comprising a date module plate having seven varieties of one month date module sections on its face at the angularly spaced positions, each the section having the characters of one month dates which are sequentially arranged in seven columns in which the position of the first character is different in turn by one column from each of the other date module sections, the date module plate being rotatably mounted at the back of a dial in coaxially over-lapped relation therewith and adapted to angularly rotate upon operating a manipulating part on a watch case, the dial being provided with a window for indicating therethrough an optionally selected one of the date module sections and also provided in the vicinity of the upper end of the window with a sequence of characters showing the seven days of week from Sunday to Saturday and are positioned respectively aligned with the seven columns of each of the date module sections.

4 Claims, 6 Drawing Figures

CALENDAR WATCH

BACKGROUND OF THE INVENTION

The present invention relates to a calendar watch having therein an improved perpetual calendar indicating mechanism.

As a calendar watch of the type that is adapted to indicate the dates of one month arranged in seven columns and a sequence of the seven days in aligned with the seven columns of the date so as to make up a monthly calendar for a required month, has been proposed a calendar mechanism in which a day module plate is rotatably mounted at the back of a stationary dial in coaxially overlapped relation therewith, the dial being provided on its face a date module consisting of seven columns of date characters of one month, and the day module plate being provided on its face seven varieties of day module sections each which consists of a sequence of date characters for seven days and has the first character different from that of the other day module sections.

In operating the above calendar watch, the day module plate is selectively rotated in the manner that a required one of the day module sections may become visible in a day indicating window formed on the dial in the vicinity of the date module thereof so as to locate the characters of seven days in aligned with the seven columns of each the date module section thus completing a monthly day and date calendar for a required month. In such construction of prior calendar watch, a required one day module section is selected from seven varieties thereof to align it with a fixed date module on the dial plate and, therefore, the sequence of the characters for a selected day module section to be indicated has to vary on each month so that it is impossible to always locate the characters of dates corresponding to Sunday in the first column of the calendar as in usual calendars. Because of such construction, the recognition of the relations between day and date is caused to be troublesome, and much more troublesome on account of the very fact that each the character of day or date in such calendar must inevitably be of small size.

Moreover, it is impossible in the above prior art watch to mark the date characters in the column corresponding to Sunday in a special distinct way, for example, in red mark since the column of characters to indicate Sunday will take different position with every other certain number of months. Therefore, the prior calendar watch has such a serious drawback that the indication of calendar is difficult to recognize for the most user who are accustomed to seeing usual calendar which has the red marked first column showing the respective dates that corresponds to Sunday. In the result of these facts, it has been a rare case for a user to enjoy convenient use of such calendar device in a watch in daily life.

The present invention is aimed to provide a calendar watch free of the drawbacks of the prior art as above set forth.

SUMMARY OF THE INVENTION

According to the present invention there is provided an improved calendar watch comprising a date module plate having seven varieties of one month date module sections on its face at the angularly spaced positions, each the section having the characters of one month dates which are sequentially arranged in seven columns and the position of the first characters therein is different in turn by one column from each of the other sections, the date module plate being rotatably mounted at the back of a dial in coaxially overlapped relation and adapted to angularly rotate upon operating a pusher or the like on a watch case, the dial being provided with a window for indicating therethrough an optionally selected one of the date module sections and also provided in the vicinity of the upper end of the window with a sequence of characters which show the seven days and are positioned to be respectively aligned with the seven columns of each of the date module sections. The primary object of the present invention is to provide an improved calendar watch associated with a calendar mechanism which is very easy to operate and recognize the same when using it.

Another object of the present invention is to provide a calendar watch which has very simple construction and has no necessity of adding its own driving mechanism.

BRIEF DESCRIPTION OF THE ATTACHED DRAWINGS

DESCRIPTION OF PREFERRED EMBODIMENTS

Now will be described in detail some preferred embodiments of the present invention with reference to the attached drawings.

Figure 1:
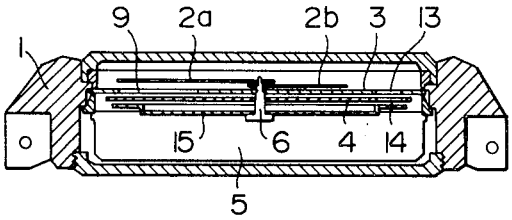
FIG. 1 is a diametric section of a calendar watch according to the present invention.

A calendar watch of the present invention as shown in FIG. 1 includes in its watch case 1 a minute hand 2*a* and an hour hand 2*b*, a dial 3, a date module plate 4, and a movement 5 for the watch including therein a driving mechanism for the calendar device.

Figure 2:
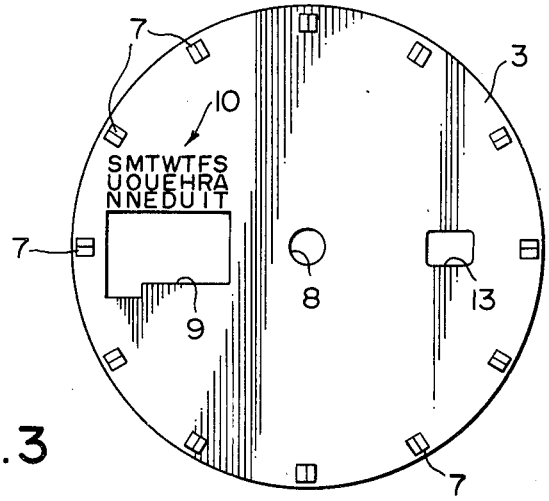
FIG. 2 is a plan view of a dial to be used in the calendar watch of FIG. 1.

The dial 3 is stationary secured in the watch case 1 and is provided, as shown in FIG. 2, with 12 hour indicating points 7 at the circumferentially equally spaced positions. The dial 3 is formed with a center opening 8 through which extends a driving axle 6 carrying at its end a minute and an hour hands 2*a*, 2*b* and also provided in an intermediate area distance from the center a window 9 through which may be selectively indicated a required one month date module section. The dial 3 is further provided in the vicinity of the upper side of the window with a sequence of characters 10 showing the seven days of week beginning with Sunday and ending with Saturday.

Figure 3:
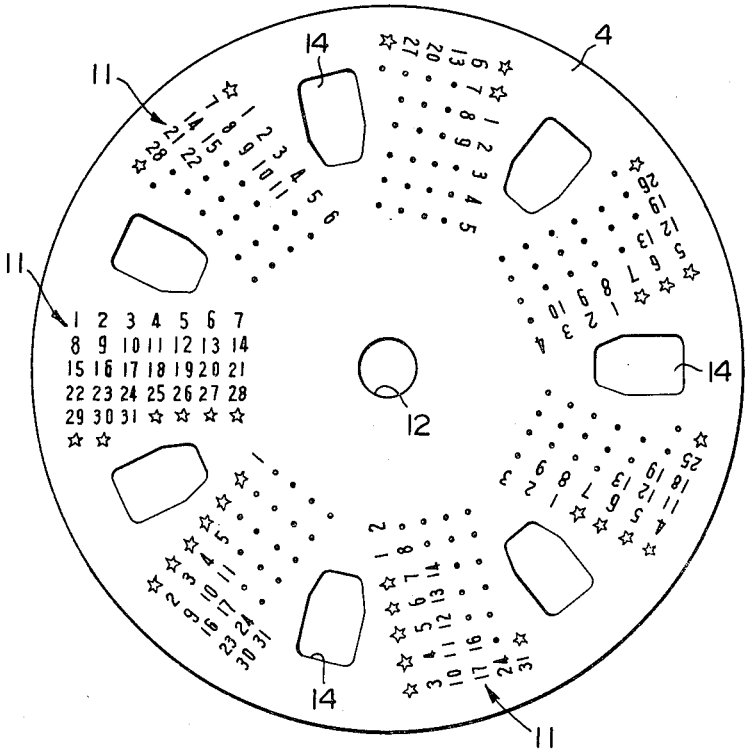
FIG. 3 is a plan view of a date module plate to be used in the calendar watch of FIG. 1.

At the back of the dial 3 there is rotatably mounted a date module plate 4 in coaxially overlapped relation with the former. The date module plate 4 is provided with, as shown in FIG. 3, a center opening 12 through which the driving axle 6 extends and seven varieties of month date module sections 11 which are marked on its face at the angularly equally spaced positions. Each of the date module sections 11 has the characters of one month dates which are sequentially arranged in seven columns in which the position of the first character is made different in turn by one column from each of the other date module section, as seen from FIG. 3. In the arrangement, the radial distance of the date characters of each the column from the center coincides with that of each the day character 10.

Figure 7:
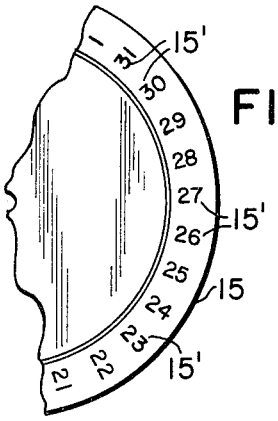
FIG. 7 is a plan view of a date indicator to be used in the calendar watch of FIG. 1.

Further, the dial 3 is formed with a date indicating window 13 adapted to successively indicate therethrough a date character for each date, this date indication being operative by means of a prior drive mechanism that has been broadly practised in the art. In connection with this date indicating window 13, the date module plate 4 is formed with, as seen from FIG. 3, seven windows 14 which are positioned respectively at the spaces between the adjacent date module sections 11, the radial distance of each the window 14 from the center being equal to that of the date indicating window 13 of the dial 3. At the back of the date module plate 4 there is mounted a prior art date indicator 15 having thereon a successive date characters circumferentially arranged along its anular zone. An example of such a date indicator 15 having date characters 15' is illustrated in FIG. 7.

Figure 4:
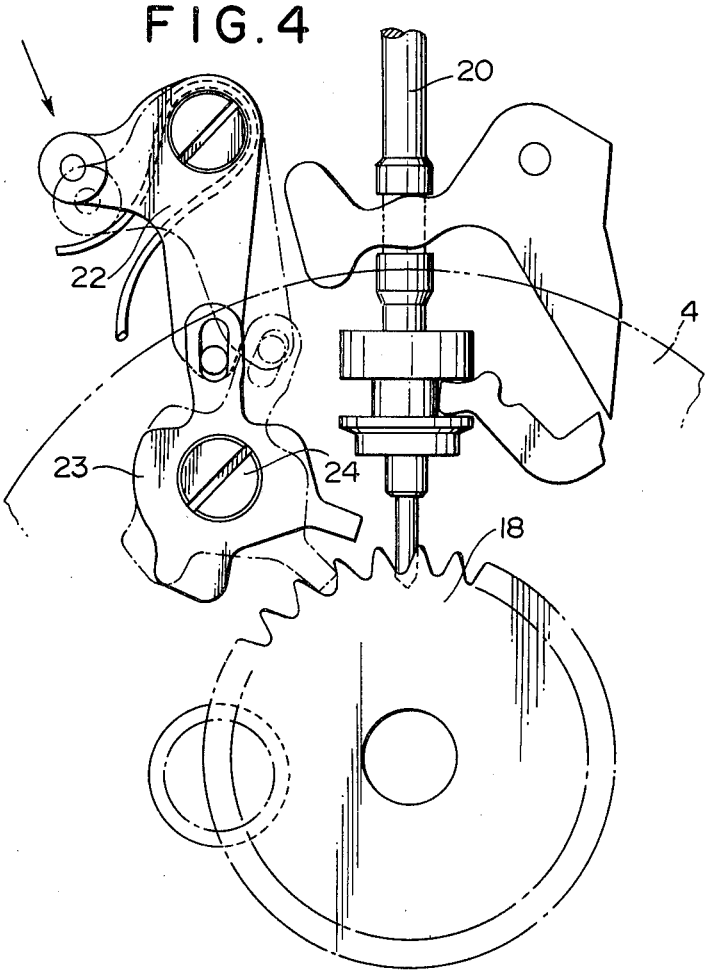
FIG. 4 is a plan view showing one exemplified driving mechanism for rotating the date module plate of the calendar watch of FIG. 1.

In FIG. 4, there is shown a preferred embodiment of a drive mechanism for rotating the date module plate 4, in which the reference numeral 22 shows a pusher or the like which is mounted on the watch case and engaged with a corrector lever 23. The reference numeral 18 shows a rotary gear wheel engaged with the corrector lever and rotatably mounted about a center axle to which is fixedly mounted the date module plate 4. The reference numeral 20 shows a winding stem having at its outer end a crown, these having the prior construction broadly practised in the calendar watch art.

The operation of the calendar device by means of the driving mechanism of FIG. 4 is as follows.

Upon depressing the pusher 22 in the direction indicated by an arrow in FIG. 4, the corrector lever 23 is given a swing motion about its axle 24 and thus the rotary gear wheel 18 is caused to rotate in an indexed manner, so that the date module plate 4 is given the same indexed rotary motion about the center axle.

Figure 6:
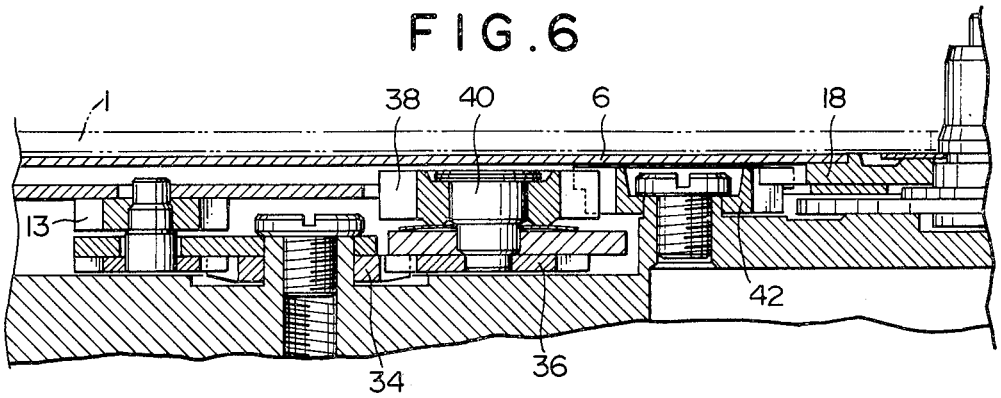
FIG. 6 is a section taken along the line A—A in FIG. 5.
Figure 5:
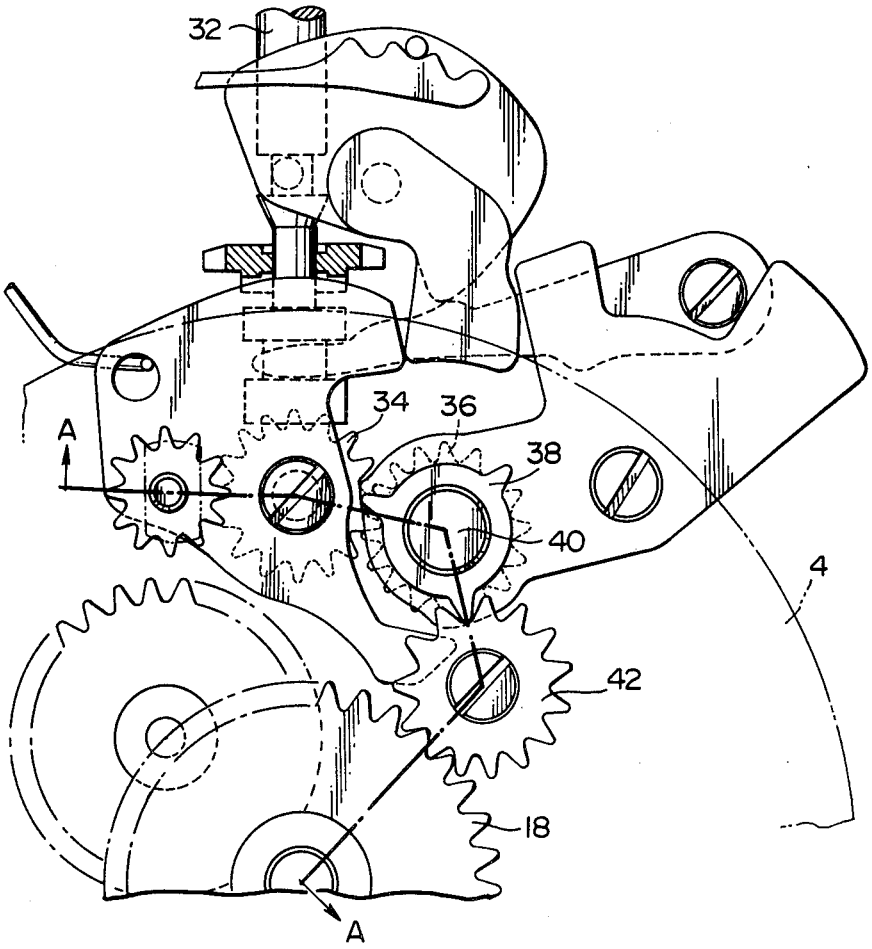
FIG. 5 is a plan view showing another embodiment of driving mechanism for the date module plate of the calendar watch of FIG. 1.

In FIGS. 5 and 6, there is shown another embodiment of driving mechanism for a calendar watch of the present invention, which mechanism mainly consisting of parts of a quick corrector mechanism of the prior art. Namely, the rotatable date module plate 4 of the present invention may be driven through a prior quick corrector mechanism by manually operating a main stem 32 of a watch.

In a prior art watch having the above mentioned quick corrector mechanism, the main stem 32 may be manually adjusted to take either one of three positions along its axial direction to perform three different functions at the respective positions. When the main stem 32 is depressed to take the most axially inner position it may be provided with a function to wind up a main spring of the watch by manually turning its crown, when the stem is positioned at axially half way position it may be provided with a function of quickly correcting the calendar indication of the prior art by manully turning the crown in either direction, and when the stem is pulled out to the axially outermost position it may be provided with a function to turn hands by turning the same.

In FIG. 5, the stem 32 shown is pulled out to the half way position and adapted to drive the calendar indications of the prior art wherein the main stem 32 is adjusted to take the position for quickly correcting the day of week indication of the prior art. In this situation, when the main stem 32 is turned in one direction to rotate a setting wheel 34 in clockwise direction, a transfer wheel 36 meshing therewith rotates in counterclockwise direction and, thus, a corrector wheel 38 mounted co-axially with the transfer wheel on a corrector wheel axle 40 also rotates in counterclockwise direction. Further, this rotation of the corrector wheel 38 is transmitted through an intermediate wheel 42 to a date module plate wheel 18, so that the date module plate 4 is caused to rotate in counterclockwise direction. In this manner, the date module plate 4 of the present invention may be driven by using the quick day correcting mechanism of the prior art.

When the main stem 32 is turned in another direction opposite to the above one to rotate a setting wheel 34 in counterclockwise direction, the above driving mechanism functions to rotate the date indicator 15 (see FIG. 1) of the prior art.

By rotating the date module plate 4 by means of the driving mechanism as above mentioned, a required one of the date module sections 11 may be selectively positioned in the date indicating window 9 of the dial 3 to make it visible over a watch glass. In this situation, each column of the date characters in the date module section is properly aligned with each the day characters 10 provided on the dial 3 at the area adjacent the window 9, so that a monthly day and date calendar for a required month that is indicative of the proper correspondence between the days and the dates may be provided on the dial 3 of the watch.

In this case, a proper group of the characters corresponding with Sunday which should be positioned in the first (the most left side) column may be selected by rotating the date module plate 4 into a proper position and, therefore, it is possible to provide a monthly calendar in which the date characters corresponding with Sunday are always especially marked, for example, in red mark for enabling a user to easily recognize the days and dates relationship as in the case of a usual wall calendar.

Therefore, according to the present invention there could be eliminated the troublesome of the prior art due to the fact that the sequence of the characters showing the seven days is inevitably varied in correcting a calendar watch.

Moreover, on account of the features of the present invention as above set forth, the size of the window 9 for indicating the dates of the month or of the watch case itself may be minimized since a calendar of a watch according to the present invention has been improved to be more easily recognized than the prior art. This advantageous feature could render a very freedom in designing a watch construction so that a unique or more advanced appearance of watch may also be otained.

I claim:

1. A calendar watch comprising a watch case, a dial mounted in the watch case, a date module plate having seven varieties of independent one month date module sections defined on its face at angularly equally spaced separate positions, each of the sections having thirty-one characters representing the dates for one month which are sequentially arranged in seven columns in which the position of the first character is different in turn by one column from each of the other sections, the last column of one date module section being spaced from the first column of the next date module section by a distance greater than the distance between adjacent columns within a date module section, the date module plate being rotatably mounted at the back of the dial in coaxially overlapped relation therewith and adapted to angularly rotate, an exterior manipulator on the watch case operable to angularly rotate the date module plate, a window in the dial for indicating therethrough an aligned selected one of the date module sections, and a sequence of characters representational of the seven days of the week defined on the dial and positioned respectively aligned with the seven columns of each of the date module sections; a date indicator containing circumferentially-spaced successive date characters mounted behind the date module plate in coaxial overlapped relation therewith, a date indicating window formed in the dial, means for rotating the date indicator so that the successive date characters are aligned with said date indicating window, and equally angularly-spaced date windows positioned in the date module plate between adjacent date module sections in such manner that one of the date windows is in alignment with the date indicating window when one of the date module sections is in alignment with the window in the dial.

2. A calendar watch as defined by claim 1, wherein the sequence of characters representational of the seven days of the week begins with a representation showing Sunday which is placed at the most left position of the sequence.

3. A calendar watch as defined by claim 2, wherein the character for Sunday is distinctively marked for the purpose of easier recognition.

4. A calendar watch as defined by claim 1 wherein the window is formed with a generally rectangular shape and the columns forming the date module sections are parallel to each other.

* * * * *